US006552309B1

(12) United States Patent
Kish et al.

(10) Patent No.: US 6,552,309 B1
(45) Date of Patent: Apr. 22, 2003

(54) PROGRAMMABLE COOKING OR BAKING APPARATUS AND METHOD

(76) Inventors: Barbara Ann Kish, 14417 Park, Livonia, MI (US) 48154; Robert Peruski, 6668 Orchard Lake Rd., Suite 204, West Bloomfield, MI (US) 48322

( * ) Notice: Subject to any disclaimer, the term of this patent is extended or adjusted under 35 U.S.C. 154(b) by 0 days.

(21) Appl. No.: 09/711,836

(22) Filed: Nov. 13, 2000

(51) Int. Cl.[7] ..... H05B 1/02

(52) U.S. Cl. ..... 219/506; 219/714; 219/413; 99/325

(58) Field of Search ..... 219/702, 714, 219/502, 494, 497, 506; 99/325–333

(56) References Cited

U.S. PATENT DOCUMENTS 4,375,586 A * 3/1983 Veda ..... 219/712
5,333,146 A * 7/1994 Vance ..... 219/383
5,611,327 A * 3/1997 Filho et al. ..... 126/39 R
5,829,341 A * 11/1998 Lin ..... 99/326
5,938,966 A * 8/1999 Oh et al. ..... 219/702
6,080,972 A * 6/2000 May ..... 219/494

* cited by examiner

*Primary Examiner*—Mark Paschall
(74) *Attorney, Agent, or Firm*—Alex Rhodes

(57) ABSTRACT

A programmable apparatus and method for controlling the time and temperature of a cooking or baking cycle. The apparatus comprises; a cooking or baking appliance, such as a conventional stove, broiler, conventional oven, convection oven, microwave oven or barbeque; a data storage and processing device such as a microprocessor or computer; a program stored in the microprocessor or computer for processing a code to control the time and temperature of the cooking or baking cycle; a device for entering the code into the microprocessor or computer; and a code which is provided by a party other than a user of the apparatus. In a first aspect of the invention, the code is a bar code on a food package and the device for entering the bar code is a scanner which is in the interior of the programmable apparatus. In another aspect of the invention, the code is entered at a remote location, such as an internet site, transmitter or a telephone apparatus.

14 Claims, 8 Drawing Sheets

37

40

PROGRAMMABLE COOKING OR BAKING APPARATUS AND METHOD

FIELD OF THE INVENTION

This invention relates to baking and cooking and more particularly to a programmable apparatus and method for controlling a cooking or baking cycle of a household appliance.

BACKGROUND OF THE INVENTION

Improper times and temperatures can reduce and destroy the taste and quality of food. In many instances, time and/or temperature must be varied during a cooking or baking cycle for optimum results. Many persons fail to follow instructions or are unaware of the best times and temperatures.

In some cases, such as defrosting in microwave ovens, heating is best done in steps. Overcooked pasta, such as noodles and spaghetti, become soggy and distasteful. High temperatures and times can destroy the flavor of foods, such as soups. Excessive times and temperatures waste energy and food resources and are unnecessarily costly to consumers.

SUMMARY OF THE INVENTION

The present invention is a means for establishing the time and temperature of a cooking or baking cycle. One benefit of the invention is that it conserves food and energy resources. Another benefit is that it simplifies cooking and baking. A still further benefit is that the cooking or baking apparatus can be pre-set to begin at a desired time. A still further benefit is that it allows a manufacturer to exercise control over the preparation of a food. A still further benefit is that a cooking or baking apparatus can be controlled from a remote location.

One characterizing feature of the invention is that the temperature and time of a baking or cooking cycle of an appliance is controlled by a code, such as a bar code. As used herein, the term appliance is intended to include all forms of appliances, such as ovens, broilers, stoves, bread making machines and barbecues and the terms cooking and baking are intended to include all processes, such as cooking, baking, barbecuing, frying and broiling.

Another characterizing feature is that the source of the code is a party other than the appliance user. Another characterizing feature is that the code is provided on a food package, such as a can or a box. Another characterizing feature is that a scanner is mounted inside of the appliance. Another characterizing feature is that the code is scanned by passing the container across a scanner window which is on the appliance. Another characterizing feature of the invention is that a numeric code can be entered at a remote site, such as the key pad of a telephone, hand held transmitter or an internet site.

After the code is scanned by passing the container across the scanner window, it is entered into a pre-programmed microprocessor which is in the interior of the appliance. In a second aspect of the invention, a numeric code is entered into a numeric keypad of a touch tone telephone and transmitted to the pre-programmed microprocessor by a telephone or wireless system. In a third aspect of the invention, a numeric code is transmitted at an internet site and entered into the pre-programmed microprocessor. In a fourth aspect of the invention, a numeric code is entered into a keypad of a hand held transmitter, transmitted to a receiver and entered into the pre-programmed microprocessor. In all aspects of the invention, a code is processed by a pre-programmed microprocessor, and the output of the microprocessor is used to control the time and temperature of a cooking or baking cycle of an appliance, such as a microwave oven, broiler, conventional oven, convection oven, barbecue or stove.

In employing the teaching of the present invention, a plurality of alternate constructions can be adopted to achieve the desired results and capabilities. In this disclosure, only several embodiments are discussed. However, the disclosed embodiments are intended as examples only and should not be considered as limiting the scope of the invention.

Further features and benefits will be apparent by reference to the drawings and ensuing detailed description of a preferred embodiment which discloses the best mode contemplated in carrying out the invention. The exclusive rights which are claimed are set forth in the numbered claims following the detailed descriptions of the preferred embodiments.

DETAILED DESCRIPTIONS OF PREFERRED EMBODIMENTS

Figure 8:
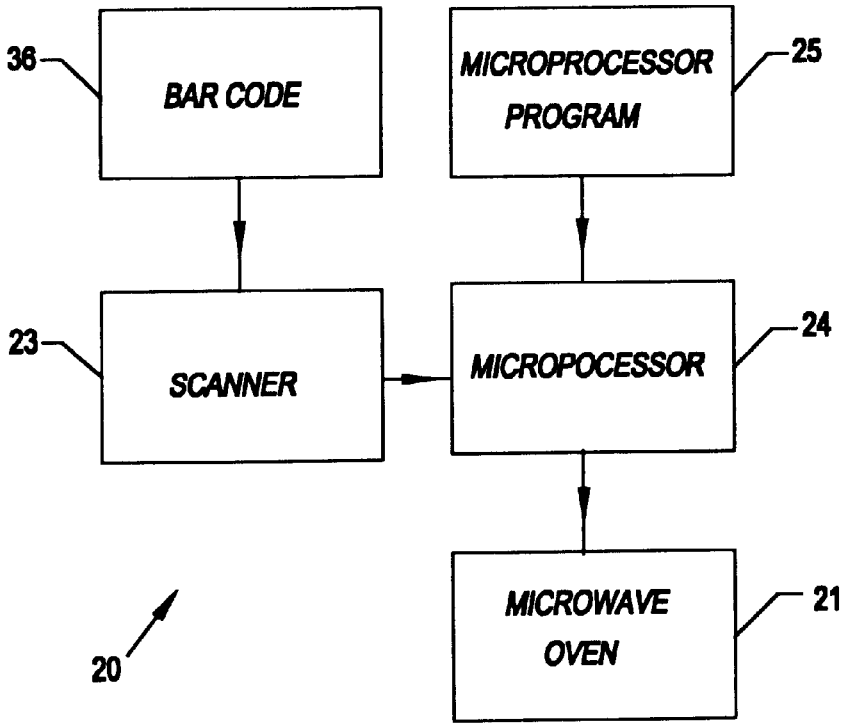
FIG. 8 is a block diagram of the FIGS. 1 through 3 embodiment.

Referring now to the drawings wherein like numerals designate like and corresponding parts throughout the several views, a cooking apparatus 20 is shown in FIGS. 1 through 3 and 8, according to the present invention. The cooking apparatus 20 which is depicted in a block diagram in FIG. 8, is comprised of a microwave oven 21, a scanner 23, a pre-programmed computer or microprocessor 24, and a stored program 25 for controlling the time and temperature of a cooking cycle of the microwave oven 21. The scanner 23 and computer or microprocessor 24 are preferably parts of the microwave oven 21.

On the front of the microwave oven 21 is a scanner window 26, a liquid crystal or LED display 27 for displaying a time and a power level, and a keypad 28. The display 27, keypad 28 and scanner window 26 are shown in enlarged form in FIG. 3. The keypad 28 includes buttons for "MANUAL" 29 and "AUTOMATIC" 30 operation, a "POWER" button 31 for manually setting the temperature, a "TIMER" button 32 for setting the beginning, period and end of a cycle, a "CLOCK" button 33 for adjusting a clock, a "START" button 34 and a "STOP" button 35. The manual operation of the microwave oven 21 is optional, it being understood that the primary object of the invention is to simplify and improve the control of the time and temperature of the microwave oven 21 with a code which is supplied on a package or a written sheet. Another object is to provide a convenient means for entering the code.

The operation of the optional manual cooking cycle is conventional and consists of the following typical steps. The manual mode is selected by depressing the "MANUAL" button 29. For maximum temperature, the power level is not reset. A cooking time is entered by depressing the number keys on the keypad 28 and the cycle is started by depressing the "START" button 34. To set the clock, the "CLOCK" button 33 is depressed, the time is entered on the keypad 28 and the "CLOCK" button 33 is again depressed. A lower power level is set by consecutively depressing the "POWER" button 31 until the desired power level appears on the display 27.

Figure 6:
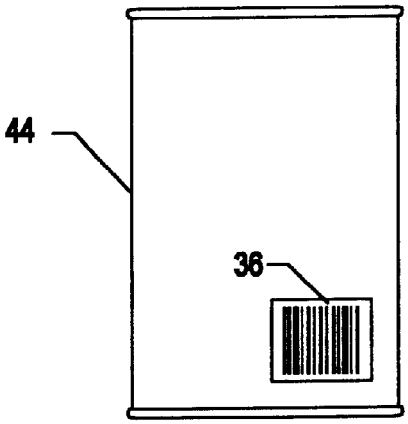
FIG. 6 is a rear view of a can with a bar code of time and temperature data.

For automatically operating the microwave oven 21, which is the object of the present invention, the "AUTO" button 30 is first depressed. A bar code 36 of a food manufacturer or supplier is entered by exposing the bar code 36 to the scanner window 26. The bar code 36 may be provided on a can 44 as shown in FIG. 6. a box (not shown) or a written instrument (not shown). The bar code 36 may be separate or included as part of a bar code which is generally provided by a manufacturer or supplier. The output of the scanner 23 is processed by the microprocessor 24 and the output of the microprocessor 24 is used to control the temperature of a cooking cycle of the microwave oven 21. As used herein the control of the microprocessor 21 includes temperature, duration, and continuous or interrupted heating. The "START" button 34 is then depressed to start the cooking cycle. To program a starting time, before the manual or automatic mode is selected, the "TIMER" button 32 is depressed, the time is entered in the key pad 28 and the "TIMER" button 32 is again depressed.

Figure 1:
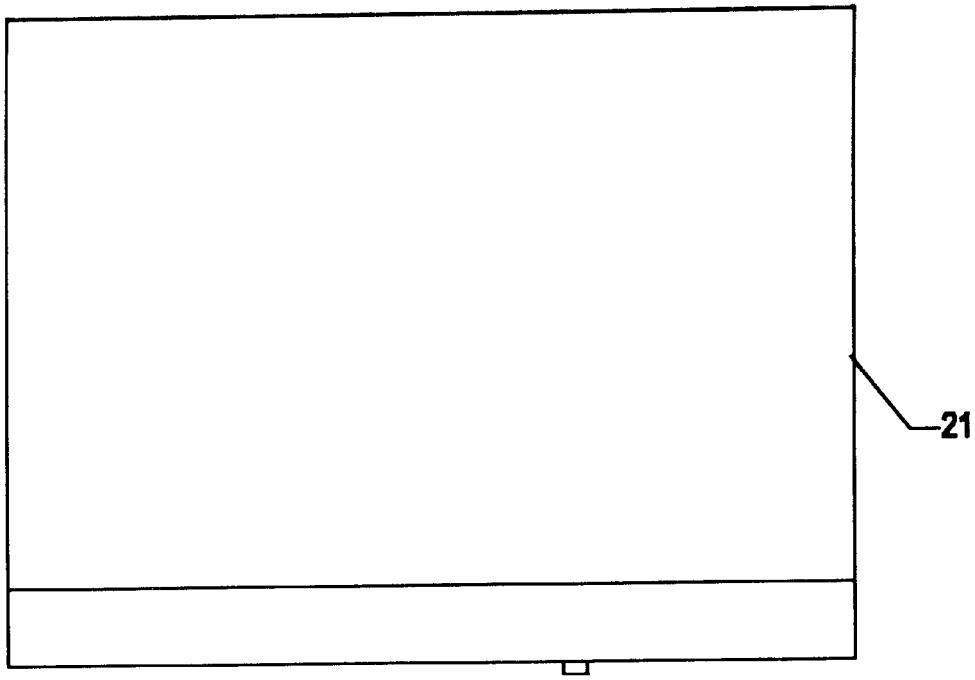
FIG. 1 is a plan view of a microwave oven according to the present invention.
Figure 2:
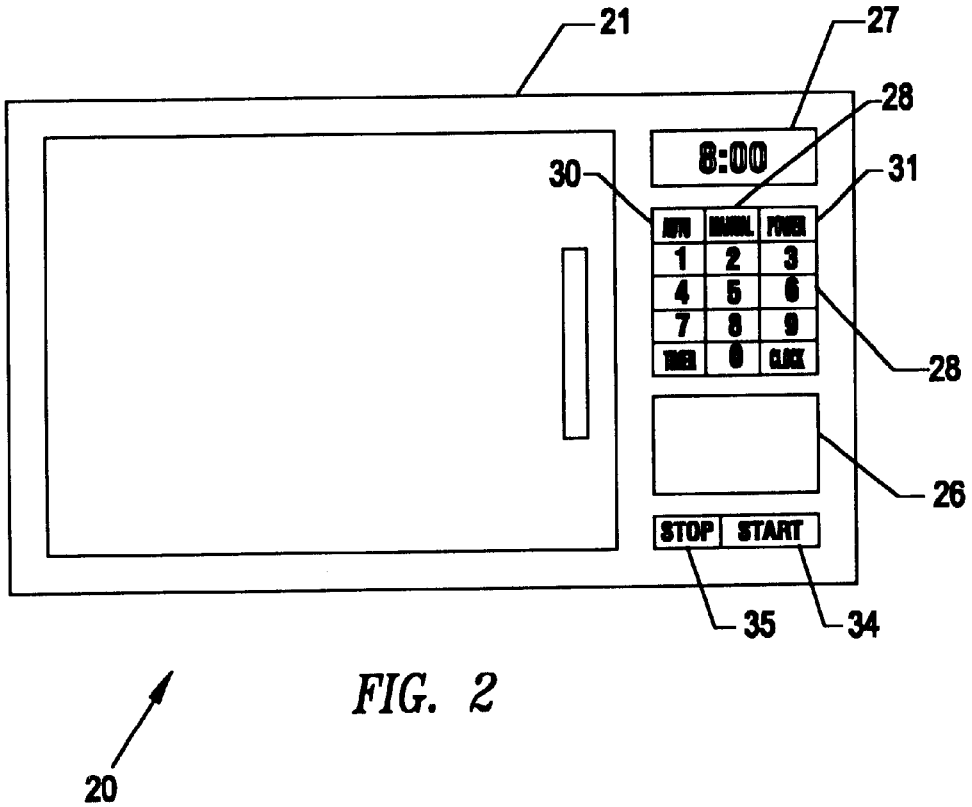
FIG. 2 is a front view of the microwave oven.
Figure 3:
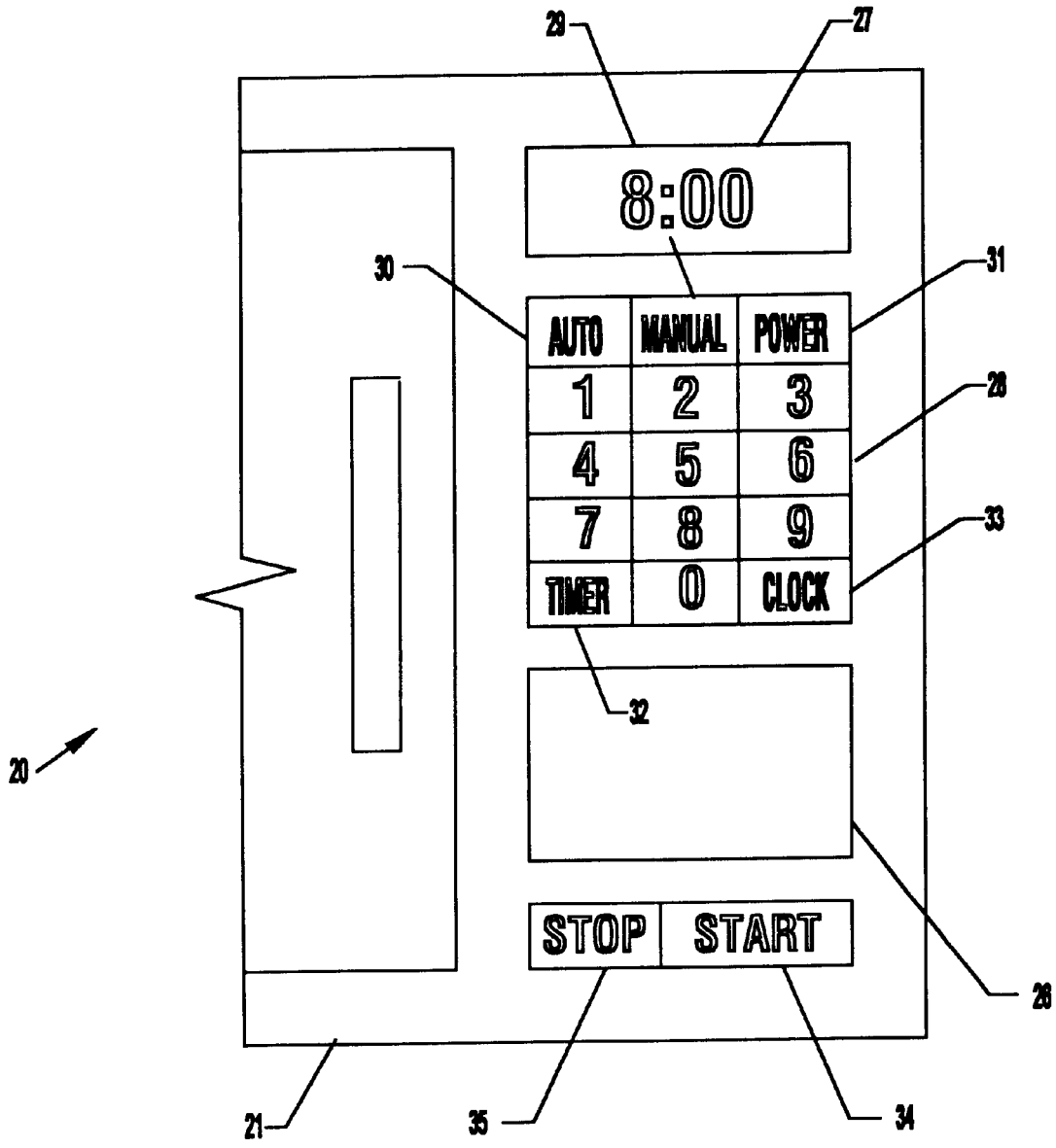
FIG. 3 is an enlarged partial view of FIG. 2.
Figure 4:
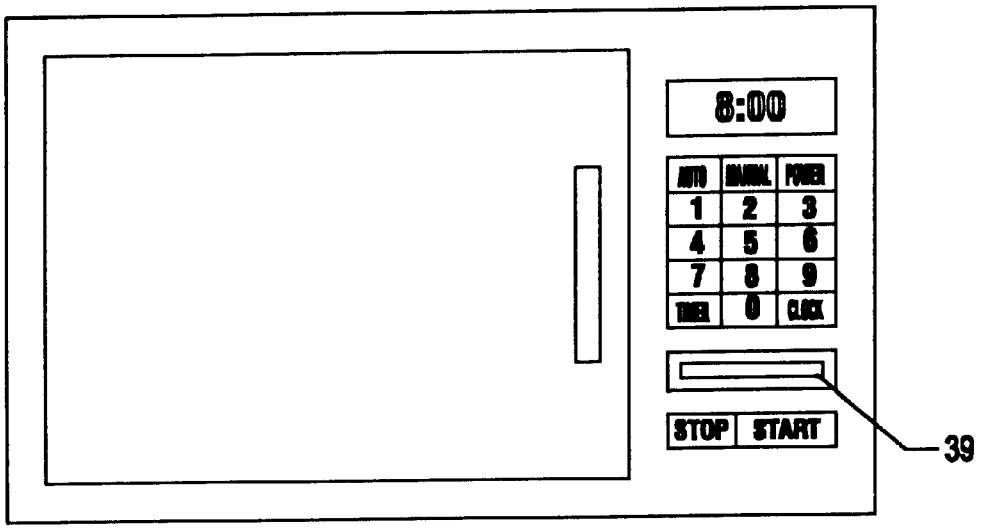
PRIOR ART FIG. 4
FIG. 4 is a front view of a prior art device.
Figure 9:
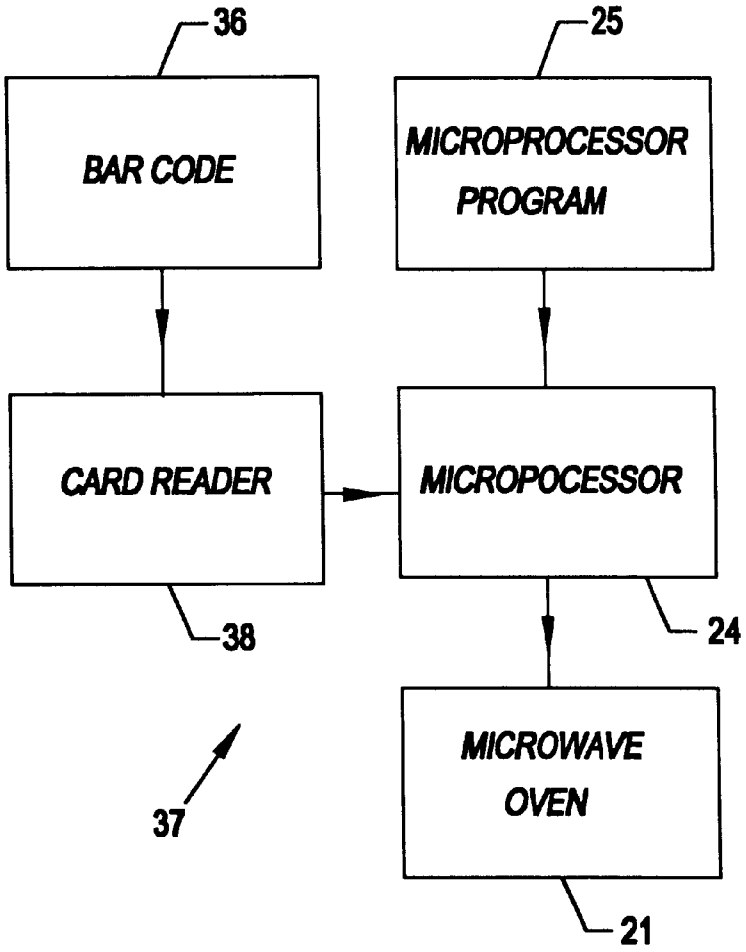
FIG. 9 is a block diagram of the FIG. 4 prior art device.

Referring now to FIGS. 4 and 9, a prior art microwave oven is shown wherein a card reader 38 is provided instead of the scanner 23. The card reader prior art embodiment 37 requires a bar code 36 marked on a standard size card (not shown). The method of using this embodiment requires a step of a reading of the bar code 36 with the card reader 38 by inserting the card into a card reader slot 39.

Figure 5:
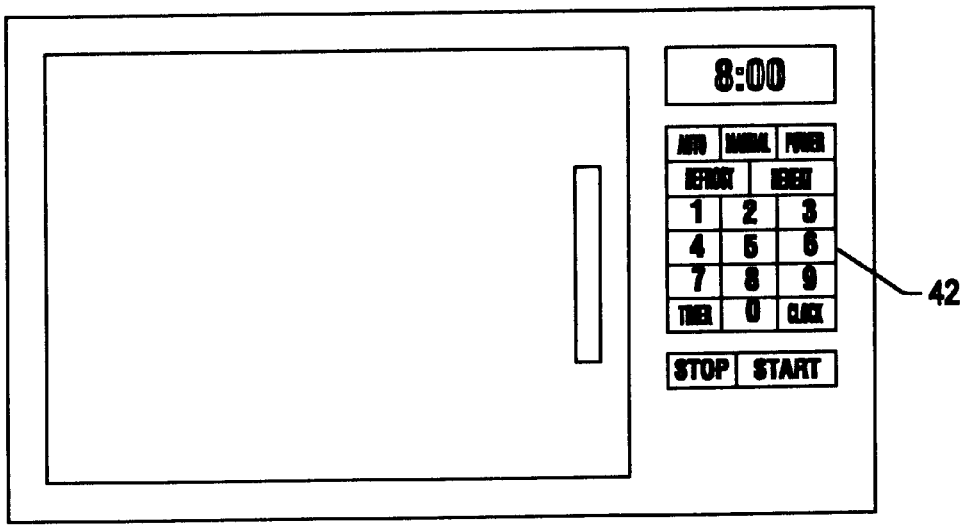
PRIOR ART FIG. 5
FIG. 5 is a front view of a prior art device.
Figure 7:
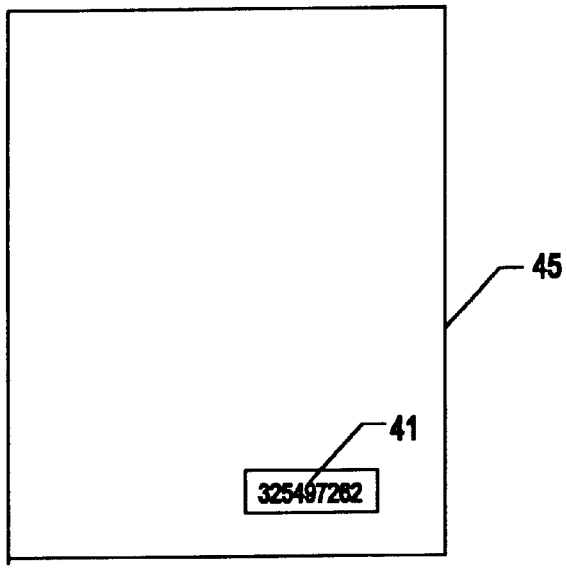
FIG. 7 is a rear view of a package with a numeric code of time and temperature data.
Figure 10:
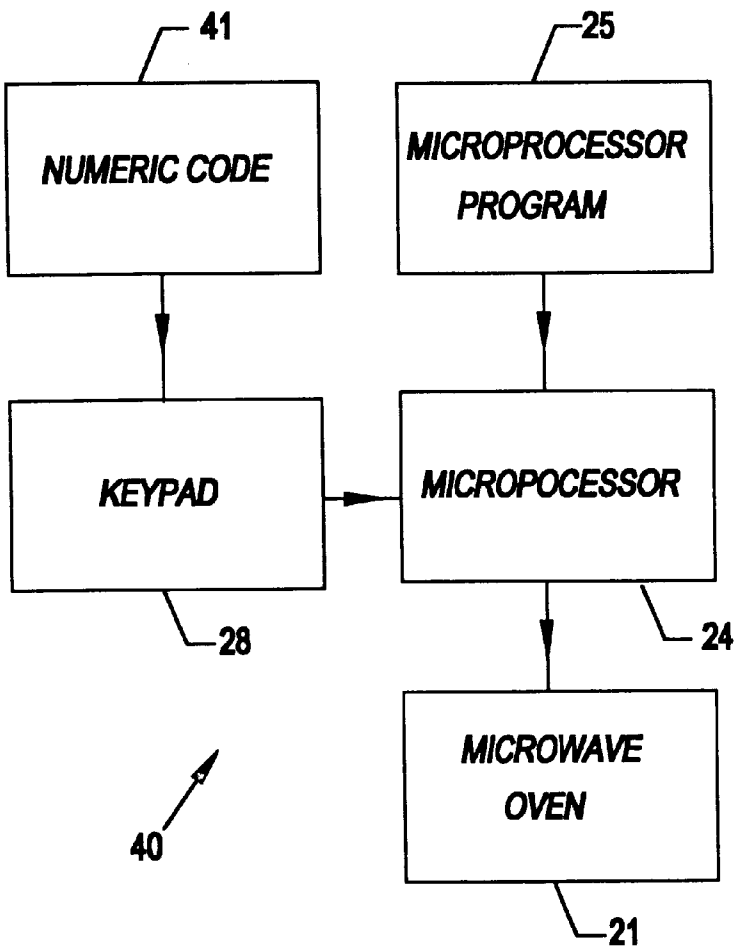
FIG. 10 is a block diagram of the FIG. 5 prior art device.

FIGS. 5 and 10, a prior art appliance 40 is shown wherein a numeric code 41 is used for controlling the time and temperature of a cooking cycle. The numeric code is entered by entering the numbers of the code 41 in a numeric keypad 42 on the front of a microwave oven 43. The code can be on a box 45, as shown in FIG. 7, or on a can (not shown) or in a written instrument (not shown) or an internet site (not shown).

Figure 11:
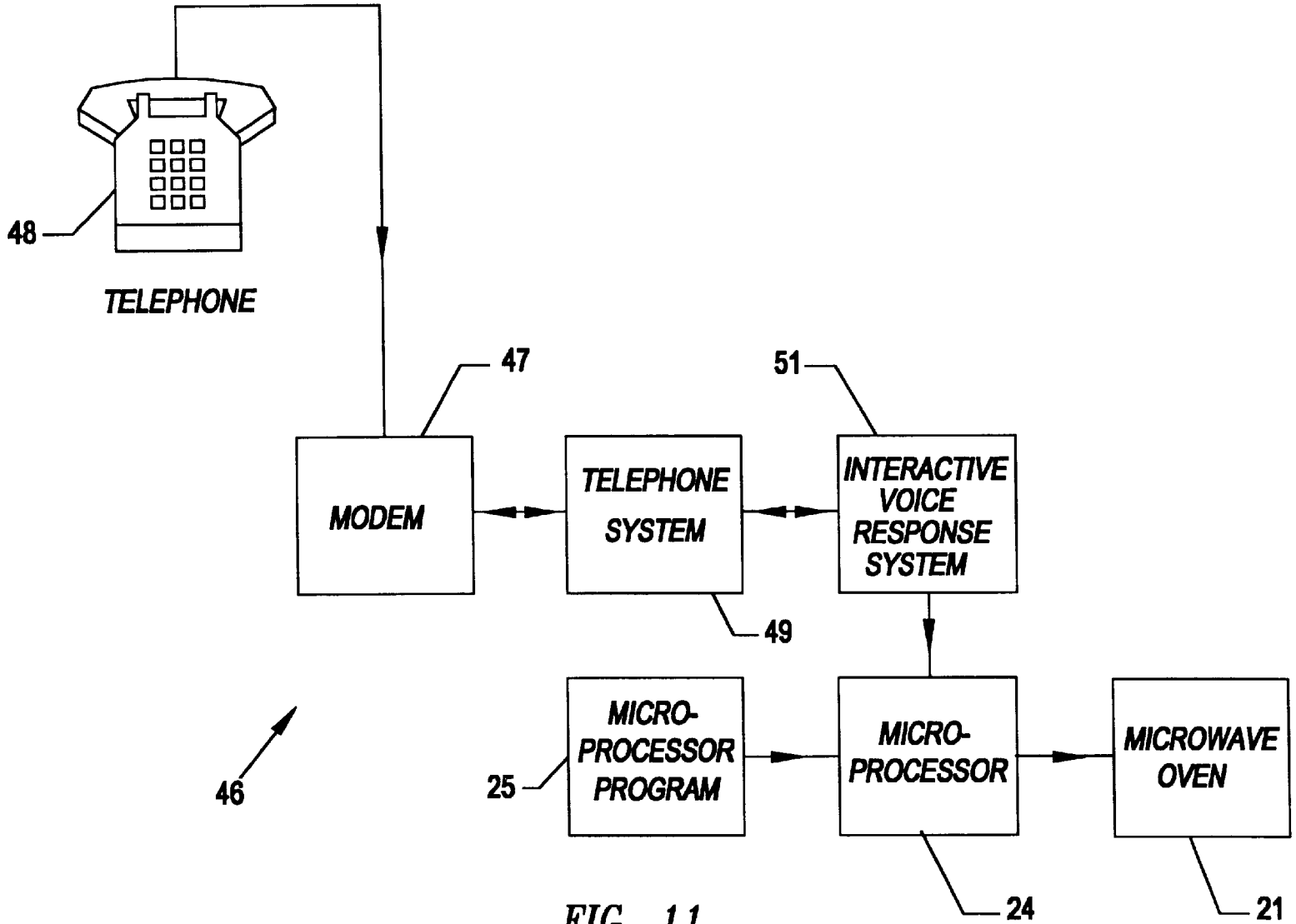
FIG. 11 is a block diagram of a second embodiment.

In FIG. 11 an embodiment 46 is shown wherein a numeric code 41 is transmitted by a telephone 48 to a remote appliance 21. The embodiment 46 is comprised of a touch tone telephone 48 with an alpha-numeric keypad 50, a modem 47, a line or wireless telephone system 49, an interactive voice response system 51, a microprocessor 24, a microprocessor software program 25 and an appliance 21, such as the microwave oven. Interactive voice response systems 47 are available from InterVoice-Brite, Inc. of Dallas, Tex. The embodiment 46 typically functions as follows. A user enters a telephone number on the telephone's keypad 50.

The telephone system 48 opens a communication channel with the interactive modem 47. The interactive modem 47 responds to the user with the following message "enter your code 41". The user enters his code 41 by pressing the appropriate keys on the telephone's keypad 50. The interactive modem 47 repeats the code and instructs the user to press a key such as the star key if the code 41 is correct. After the user presses the star key, the modem 47 instructs the user to press a number key, such as the #1 key, if he desires to delay the start of the cooking or baking cycle. If the user presses the number key, the modem 47 requests the user to enter the delay time on the key pad 50. After the user enters the delay time, the modem 47 repeats the delay time and instructs the user to press the star key if the time is correct. The modem then prompts the user to enter a code for controlling the time and temperature of the cooking cycle. After the user enters the code and responds to a request to verify the correctness of the entry by pressing a key, such as the star key, the appliance 21 is programmed to start at the delayed time at the given temperature and time.

Figure 12:
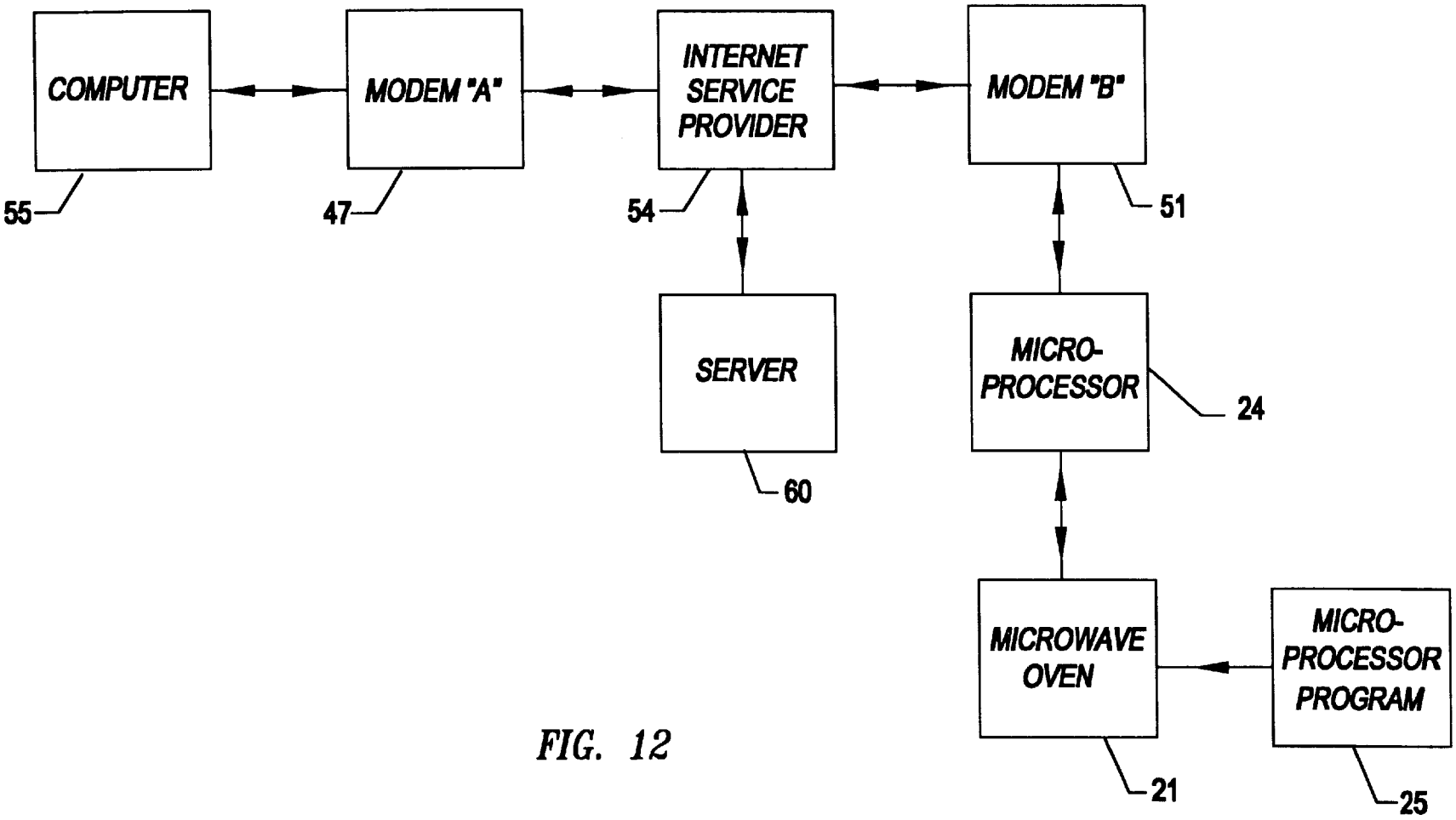
FIG. 12 is a block diagram of a third embodiment.

In the embodiment 53 of FIG. 12 a code for controlling the time and temperature of a cooking or baking cycle of an appliance 21 is obtained from a server computer 60 which is linked to a personal computer 55 by an internet service provider 54. The server 60 may be the server 60 of a food supplier, a manufacturer or an independent party. The embodiment 53 is comprised of the personal computer 55, a first modem 47, the internet service provider 54, a second modem 51, a microprocessor 24, a microprocessor program 25 and an appliance 21. The personal computer 55 communicates with the server 54 through the internet service provider 54. After the code 61 is selected at the personal computer 55, it is E-mailed to the microprocessor 24 via the internet service provider 54 and the second modem 51. It is processed in the microprocessor 24 and the output of the microprocessor 24 is used to control the cooking or baking cycle of the appliance 21.

Figure 13:
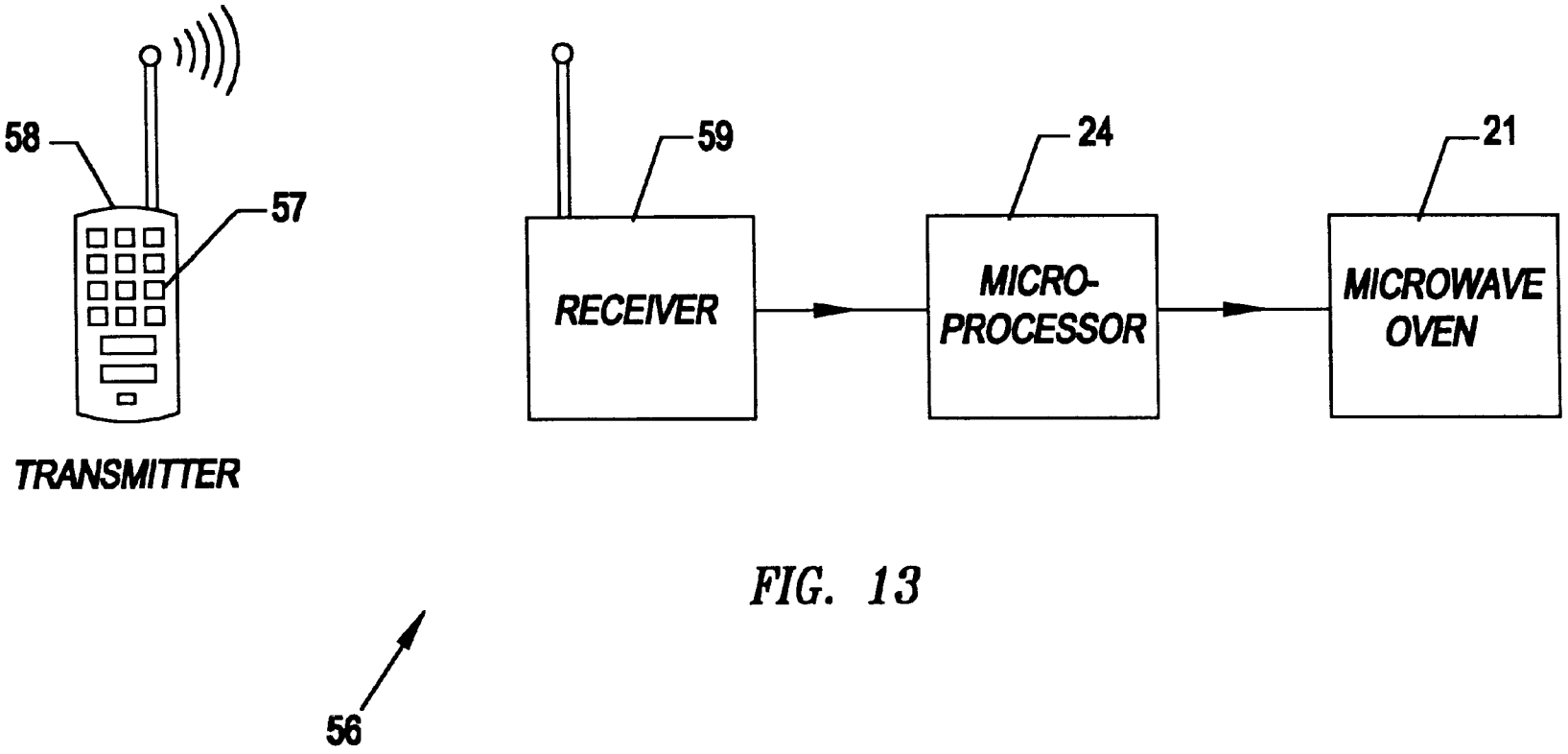
FIG. 13 is a block diagram of a fourth embodiment.

In FIG. 13, an embodiment 56 is shown wherein a numeric code 41 for a cooking or baking cycle is entered into a keypad 57 of a hand held transmitter 56 and transmitted to a receiver 59 at a remote location. The code 41 is processed in the microprocessor 24 and the output of the microprocessor 24 is used to control the time, temperature and start of a cooking or baking cycle of an appliance 21.

From the foregoing it will be appreciated that our invention simplifies and improves a cooking and baking cycle as well as conserving energy and food resources.

Although only several embodiments have been described, it will be understood that after having the benefit of our disclosure, other embodiments can be derived by changes such as substitutions of parts, changes in the arrangements of part, changes in materials, and changes in the design of parts without departing from the spirit thereof.

We claim:

1. In combination, a container having a code on an exterior surface thereof; a food product; and a stand alone appliance, such as a stove, broiler, oven, convection oven, and microwave, said appliance having a control system for automatically operating said appliance, said control comprising: a non-contact scanner mounted in an interior portion of said appliance; a scanner window on an outer surface of said appliance for allowing a user of said appliance to scan said code by passing said container across said scanner window; a programmable data storage and processing device such as a microprocessor or computer mounted in said interior of said appliance for processing data from said scanner; and a computer program stored in said microprocessor or computer.

2. The combination recited in claim 1 wherein said container is a can.

3. The combination recited in claim 1 wherein said container is a box.

4. The combination recited in claim 1 wherein said code is a bar code.

5. The stand alone self contained programmable appliance recited in claim 1 wherein said means for transmitting said code to said computer or microprocessor from said site which is remote from said cooking or baking appliance is a telephone apparatus.

6. The stand alone self contained programmable appliance recited in claim 1 wherein said means for transmitting said code to said computer or microprocessor from said site which is remote from said cooking or baking appliance is an internet site and a telephone apparatus.

7. A method for automatically controlling times and temperatures of a cooking or baking cycle of a stand alone self contained appliance, such as a stove, broiler, convection oven or microwave oven comprising: the steps of scanning a bar code on a food package with a scanner mounted in an interior of said appliance, processing an output of said scanner in a programmed data storage and processing device mounted in an interior of said appliance; using an output of said data storage and processing device to automatically control the times and temperatures of said cooking or baking cycle of said appliance.

8. The automated method recited in claim 7 further comprising the steps of entering a time for beginning said cooking or baking cycle in a keypad of said appliance; entering a time for ending said cooking or baking cycle in said key pad of said appliance; processing said data in said pre-programmed data storage and processing device of said appliance; using said output of said data storage and processing device to control the beginning and ending times of said cooking or baking cycle of said appliance.

9. An automated method for controlling times and temperatures of a cooking or baking cycle of a stand alone self contained appliance, such as a stove, broiler, convection oven or microwave oven comprising: the steps of reading a bar code of time and temperature data with a card reader of said appliance mounted in said appliance, processing said code in a pre-programmed data storage and processing device of said appliance; using an output of said data storage and processing device to control a cooking or baking cycle of said appliance.

10. In a stand alone appliance, such as a stove, broiler, oven, convection oven, microwave oven or barbecue for heating a food product in said appliance, the improvement comprising: a control mounted in said appliance for automatically operating said appliance, said control having a non-contact bar code scanner mounted in an interior portion of said appliance for scanning a bar code on a container; a scanner window on an outer surface of said appliance for allowing a user to scan said bar code by passing said container across said scanner window; a programmable data storage and processing device such as a microprocessor or computer mounted in said interior of said appliance for processing data from said scanner; and a computer program stored in said microprocessor or computer.

11. In a stand alone appliance, such as a stove, broiler, oven, convection oven, microwave oven or barbecue for heating a food product in said appliance, a non-contact for operating said appliance, said non-contact means comprising: an input device mounted in an interior portion of said appliance for receiving data from a source which is remote from said input device; a means for transmitting data from said remote source; a programmable data storage and processing device such as a microprocessor or computer mounted in said interior of said appliance for receiving and processing data from said input device; and a computer program stored in said microprocessor or computer.

12. The stand alone appliance recited in claim 11 wherein said input device is a bar code scanner, 13. The stand alone appliance recited in claim 11 wherein said data from said source is a bar code.

14. The stand alone appliance recited in claim 11 wherein said source is a container.

* * * * *